US012601183B2

(12) United States Patent
Fraser et al.

(10) Patent No.: US 12,601,183 B2
(45) Date of Patent: Apr. 14, 2026

(54) THERMAL INSULATION PAD

(71) Applicant: SFS Group Fastening Technology Ltd., Welwyn Garden City (GB)

(72) Inventors: David Fraser, Welwyn Garden City (GB); Ben Kemp, Welwyn Garden City (GB); Oscar Gleave, Glasgow (GB)

(73) Assignee: SFS Group Fastening Technology Ltd., Welwyn Garden City (GB)

( * ) Notice: Subject to any disclaimer, the term of this patent is extended or adjusted under 35 U.S.C. 154(b) by 246 days.

(21) Appl. No.: 17/759,363

(22) PCT Filed: Jan. 28, 2021

(86) PCT No.: PCT/GB2021/050202
§ 371 (c)(1),
(2) Date: Jul. 22, 2022

(87) PCT Pub. No.: WO2021/152317
PCT Pub. Date: Aug. 5, 2021

(65) Prior Publication Data

US 2022/0372766 A1 Nov. 24, 2022

(30) Foreign Application Priority Data

Jan. 29, 2020 (GB) ..... 2001218

(51) Int. Cl.
*E04F 13/08* (2006.01)
*E04B 1/74* (2006.01)

(52) U.S. Cl.
CPC ..... *E04F 13/0805* (2013.01); *E04B 1/74* (2013.01); *E04F 13/0857* (2013.01); *E04F 13/0801* (2013.01); *E04F 13/081* (2013.01); *E04F 13/0875* (2013.01)

(58) Field of Classification Search
CPC ... E04F 13/0805; E04F 13/0857; E04F 13/08; E04F 13/0801; E04F 13/081; E04F 13/0875; E04B 1/74; E04B 2001/389; E04B 1/8209
See application file for complete search history.

(56) References Cited

U.S. PATENT DOCUMENTS 1,770,200 A * 7/1930 Comstock ..... E04B 1/803 52/576
4,683,154 A * 7/1987 Benson ..... E06B 3/66304 156/107
5,107,649 A * 4/1992 Benson ..... E04C 2/34 52/794.1
5,175,975 A * 1/1993 Benson ..... F01N 3/2882 52/794.1

(Continued)

FOREIGN PATENT DOCUMENTS

DE 29610367 U1 11/1996
DE 19635971 A1 * 3/1998 ..... B29C 63/38

(Continued)

*Primary Examiner* — Omar F Hijaz
(74) *Attorney, Agent, or Firm* — Withrow + Terranova, PLLC; Vincent K. Gustafson

(57) ABSTRACT

A thermal insulation pad is for attachment between a bracket and substructure in a building cladding assembly. The thermal insulation pad includes a thermal insulation material and at least one spacing member for limiting compression of the thermal insulation material during use.

20 Claims, 5 Drawing Sheets

(56) References Cited

U.S. PATENT DOCUMENTS

| | | | | | |
|---|---|---|---|---|---|
| 5,226,274 | A * | 7/1993 | Sommerstein | E04F 13/0805 | 52/509 |
| 6,037,033 | A * | 3/2000 | Hunter | B32B 3/28 | 428/184 |
| 9,389,013 | B2 * | 7/2016 | Rolek | A47F 3/0426 | |
| 9,726,438 | B2 * | 8/2017 | Smith | F28D 20/023 | |
| 10,221,573 | B2 * | 3/2019 | Krause | E04F 13/0803 | |
| 10,273,686 | B2 * | 4/2019 | Lake | E04B 1/7612 | |
| 2013/0074431 | A1 * | 3/2013 | Croasdale | E04B 1/7604 | 52/309.4 |
| 2014/0026510 | A1 * | 1/2014 | Kubassek | E04B 2/58 | 52/512 |
| 2015/0128518 | A1 * | 5/2015 | Knight | E04F 13/0807 | 52/404.1 |

FOREIGN PATENT DOCUMENTS

| | | | | | |
|---|---|---|---|---|---|
| DE | 68928547 | T2 | 4/1998 | | |
| DE | 102012016025 | B4 * | 2/2020 | E04F 13/0807 | |
| GB | 2420130 | A | 5/2006 | | |
| GB | 2541513 | A | 2/2017 | | |
| GB | 2559905 | A | 8/2018 | | |
| GB | 2567803 | A | 5/2019 | | |
| RU | 196049 | U1 * | 2/2020 | E04B 1/74 | |
| WO | WO-2016207648 | A1 * | 12/2016 | E04B 1/24 | |
| WO | WO-2019048869 | A1 * | 3/2019 | E04F 13/0801 | |

* cited by examiner

THERMAL INSULATION PAD

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to a thermal insulation pad. In particular to a thermal insulation pad for attachment between a bracket and substructure in a building cladding assembly.

2. Description of Related Art Including Information Disclosed Under 37 CFR 1.97 and 37 CFR 1.98

The habitation of buildings represents a significant contributor of greenhouse gases. A high proportion of such emissions results from heating and cooling systems in those buildings. In the modern world, where policy makers are facing increasing public pressures with respect to climate change, new buildings (and older buildings subject to renovation) are generally required to satisfy stringent and evolving energy efficiency and insulation standards.

The use of exterior cladding assemblies comprising a framework structure coupled to the exterior wall of a building with exterior cladding panels connected to the framework are now well known. The exterior cladding panels can be engineered to provide various aesthetic characteristics in addition to useful thermal and weather resistant properties. For example, the cladding panels and frame structure can comprise a rain-screen system.

Historically, a shortcoming with these assemblies has been the connection between the exterior cladding framework structure and the exterior wall of the building, which has provided a thermal path for the escape of thermal energy.

As a solution to this problem it has been known to attach brackets forming part of the exterior cladding assemblies to the exterior walls of the building via thermal insulation layers. An exemplary system is known from GB 2559905 A. Whilst this has significantly improved thermal efficiencies with the insulation layer acting as a thermal break between the building and the cladding assembly, the present inventors have determined scope for improving the thermal efficiency of such systems.

BRIEF SUMMARY OF THE INVENTION

The present invention arose in a bid to provide an improved building cladding assembly offering improved thermal performance.

According to the present invention in a first aspect, there is provided a thermal insulation pad for attachment between a bracket and substructure in a building cladding assembly, the thermal insulation pad comprising a thermal insulation material and at least one spacing member for limiting compression of the thermal insulation material during use.

In the present context, the substructure may, for example, comprise a structural element forming part of the cladding assembly or may comprise the building.

By the provision of the spacing member, which is not compressed during normal loading (i.e. under the compressive loading the thermal insulation pad is subjected to by fixings (typically, but not exclusively, screw fixings, such as self tapping/driving fixings) when the bracket is fixed to the substructure in use) compression of the thermal insulation pad is effectively controlled. By restricting compression of the thermal insulation layer/pad the thermal insulation performance of the pad is effectively maintained. In this regard, it has been determined by the present inventors that thermal insulation performance degrades significantly with a reduction in thickness (by compression) of prior art thermal insulation pads, such as the thermal insulation pad disclosed in the referenced prior art above. In that arrangement without any spacing member, the retainer is crushed during installation with the insulation pad compressed to around 50% of its uncompressed thickness.

The space between the bracket and the substructure in use may be substantially filled by the thermal insulation pad. In such arrangements, the spacing between the bracket and the substructure will be equal to the relevant dimension of the spacing member. In alternative arrangements, an adaptor may be provided along with the thermal insulation pad to lie between the backet and the substructure.

The relevant dimension of the spacing member may be substantially equal to the uncompressed thickness of the insulation material comprising the thermal insulation pad. It will typically be slightly smaller than the uncompressed thickness of the insulation material comprising the thermal insulation pad. Regardless, it will limit compression of the thermal insulation material during use.

The material of the spacing member will be less compressible than the thermal insulation material comprising the thermal insulation pad. The spacing member may be embedded in the thermal insulation material/pad. The spacing member preferably comprises a material with good thermal insulation properties that is sufficiently uncompressible under the required compressive loading during use. In this regard the material is not particularly limited. The spacing member most preferably comprises a ceramic material, however.

The specific form of the spacing member is also not particularly limited. The spacing member may comprise a bead. It could comprise an alternatively shaped element and may, for example, comprise a cube or otherwise. Ceramic beads are preferred, since they have been determined to be readily available at a low cost and to meet the requirements of thermal insulation and non-compressibility. Regardless of form and material, there is most preferably an array of spacing members provided so as to allow for balanced loading. A plurality of openings may be provided in the thermal insulation pad for receiving the spacing members. In such case, each of the openings is preferably arranged such that there is an interference fit between the opening and the respective spacing member received thereby. The spacing members are thereby embedded in the thermal insulation material. Whilst an array of spacing members is preferred, in alternative arrangements, there may be a single suitably formed/shaped/sized spacing element, which may be embedded in the thermal insulation member or otherwise attached thereto in the form of a frame extending around the periphery of the thermal insulation material/pad or otherwise.

According to the present invention in a further aspect, there is provided a thermal insulation pad assembly comprising a thermal insulation pad as defined above and an attachment element for attaching the thermal insulation pad to a bracket in a building cladding assembly.

In a preferred arrangement, the attachment element comprises a sleeve, which may be formed from cardboard. In alternative arrangements, the attachment means may comprise adhesive.

According to the present invention in a yet further aspect, there is provided a bracket for attachment to a substructure in a building cladding assembly, the bracket comprising a foot having a contact face to face towards the substructure in use and a thermal insulation pad, or a thermal insulation pad assembly, as defined above attached to the foot, such that the thermal insulation pad sits between the contact face and the substructure in use.

The thermal insulation pad preferably has a footprint substantially equal to the footprint of the foot.

Further, preferred, features are presented in the dependent claims.

BRIEF DESCRIPTION OF THE SEVERAL VIEWS OF THE DRAWINGS

Exemplary embodiments of the invention will now be described with reference to the accompanying drawings.

FIGS. 5*a* and 5*b* show perspective views of a bracket similar to that shown in FIG. 4 but provided with an adaptor, wherein FIG. 5*a* shows an exploded perspective view of the components and FIG. 5*b* shows a perspective view of the assembled bracket.

DETAILED DESCRIPTION OF THE INVENTION

Figure 1:
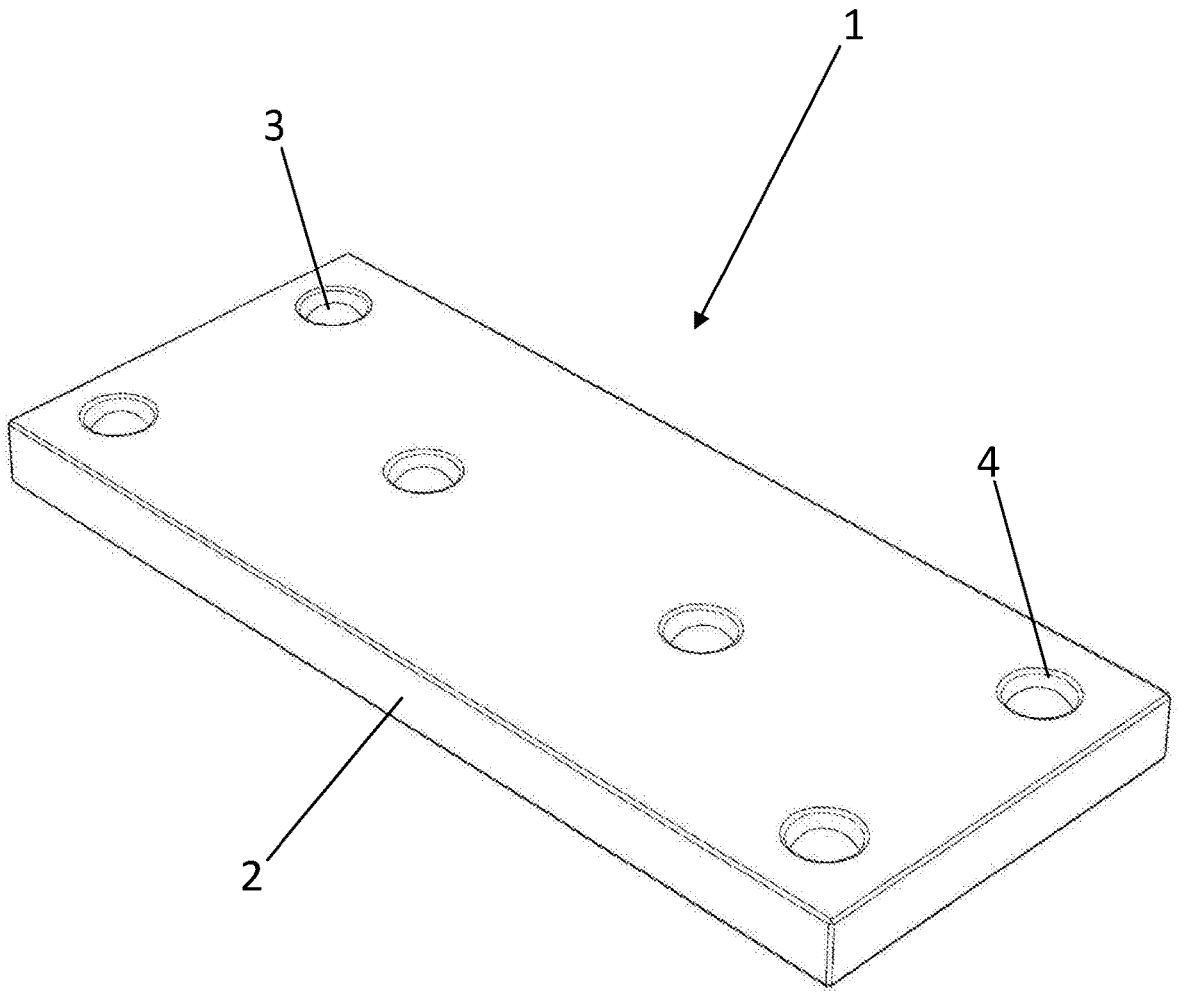
FIG. 1 shows a perspective view of a thermal insulation pad according to an embodiment of the present invention.

With reference to FIG. 1, there is shown a thermal insulation pad 1 for attachment between a bracket (6, FIGS. 3 and 4) and substructure (not shown) in a building cladding assembly (not shown), the pad comprising a thermal insulation material 2 and at least one spacing member 3 for maintaining a predetermined spacing between the bracket and substructure during use.

The thermal insulation material may comprise a fibrous material. In a particularly preferred arrangement, it comprises a silica aerogel. An exemplary silica aerogel comprises 'AEROGEL POLY'™ manufactured by AMA Composites S.r.l. The thermal insulation pad may be formed by cutting a sheet of suitable thickness to the required dimensions. It should be noted that a range of differently sized pads may be made available to suit a range of differently sized brackets. Note, for example, the differing pad sizes in FIGS. 3 and 4. In exemplary arrangements, the thermal insulation pad has an uncompressed thickness of 10 mm. It could, however, be thicker or thinner, as appropriate.

The spacing member 3 is less compressible than the thermal insulation pad and, as discussed, acts to restrict compression of the thermal insulation material/pad in a thickness direction. For such purposes, the spacing member 3 preferably has a dimension substantially equal to the thickness of the thermal insulation material when the thermal insulation material is in an uncompressed state.

As is preferred, in the present arrangement there is a plurality of spacing members 3 provided, such that loads are balanced. Specifically, in the present arrangement, there are six spacing members 3 provided in an array. It should be appreciated that in alternative arrangements there may be more or less spacing members provided. The spacing members 3 comprise ceramic beads that have a thickness slightly less than the uncompressed thickness of the thermal insulation material 2 defining the thermal insulation pad. In alternative arrangements, the spacing members 3 may be otherwise formed and need not comprise ceramic material as long as they have suitable thermal insulation properties and are uncompressible under the required working loads. As best seen in FIG. 1, there is a plurality of openings 4 provided for receiving the spacing members 3. Each of the openings 4 is arranged such that there is an interference fit between the opening 4 and the respective spacing member 3 received thereby. In alternative arrangements the openings 4 may be omitted or otherwise formed.

Whilst in the present arrangement there is an array of spacing members 3, in alternative arrangements there may be a single spacing member 3 only. Where there is a single spacing member provided, it could take the form of a frame around the periphery of the thermal insulation material or it could comprise a suitable embedded member that provides multiple spaced points of support, received by a suitably formed opening or otherwise.

Figure 2:
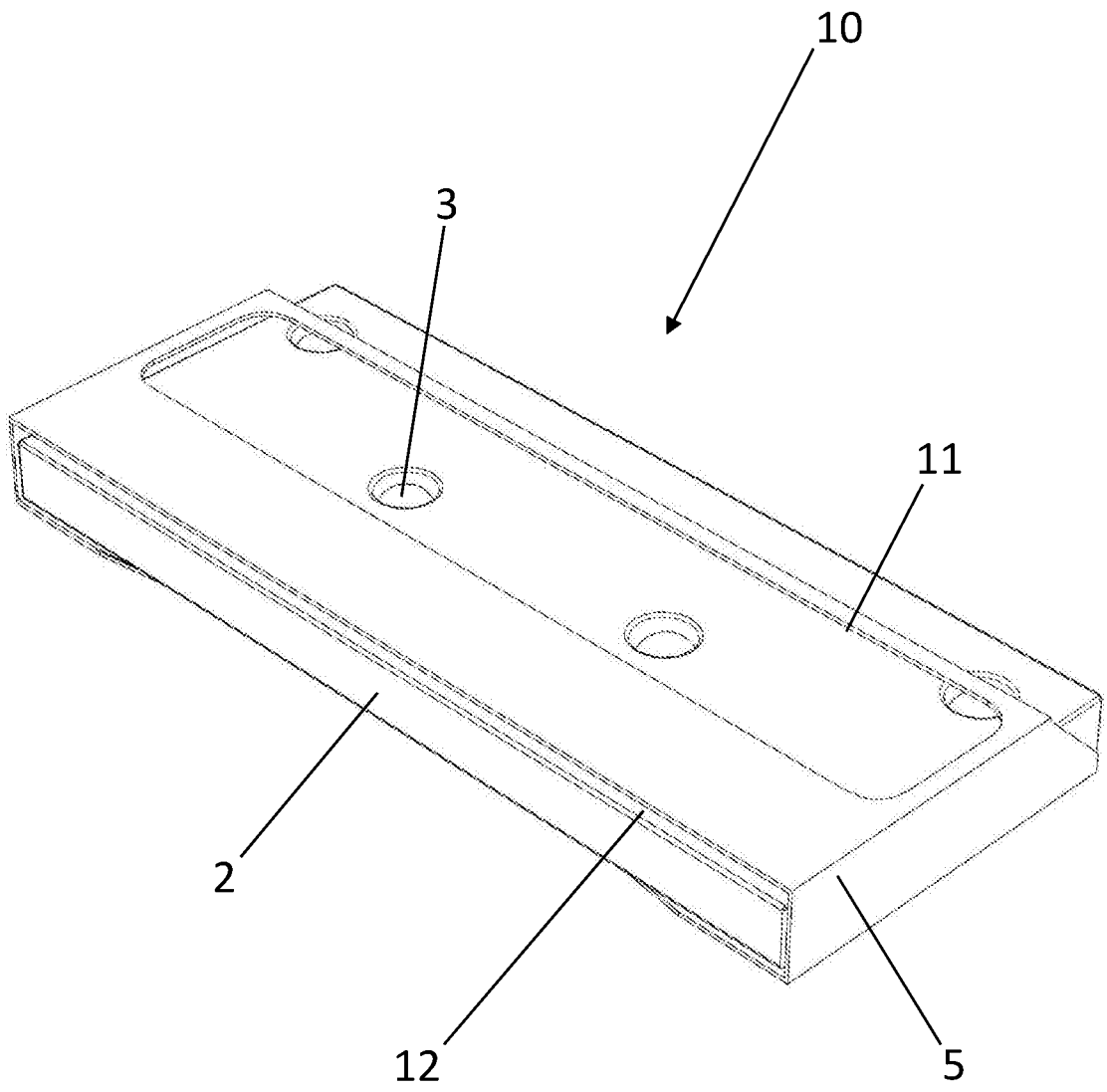
FIG. 2 shows a perspective view of a thermal insulation pad assembly comprising the thermal insulation pad of FIG. 1 and an attachment element in the form of a cardboard sleeve.
Figure 3:
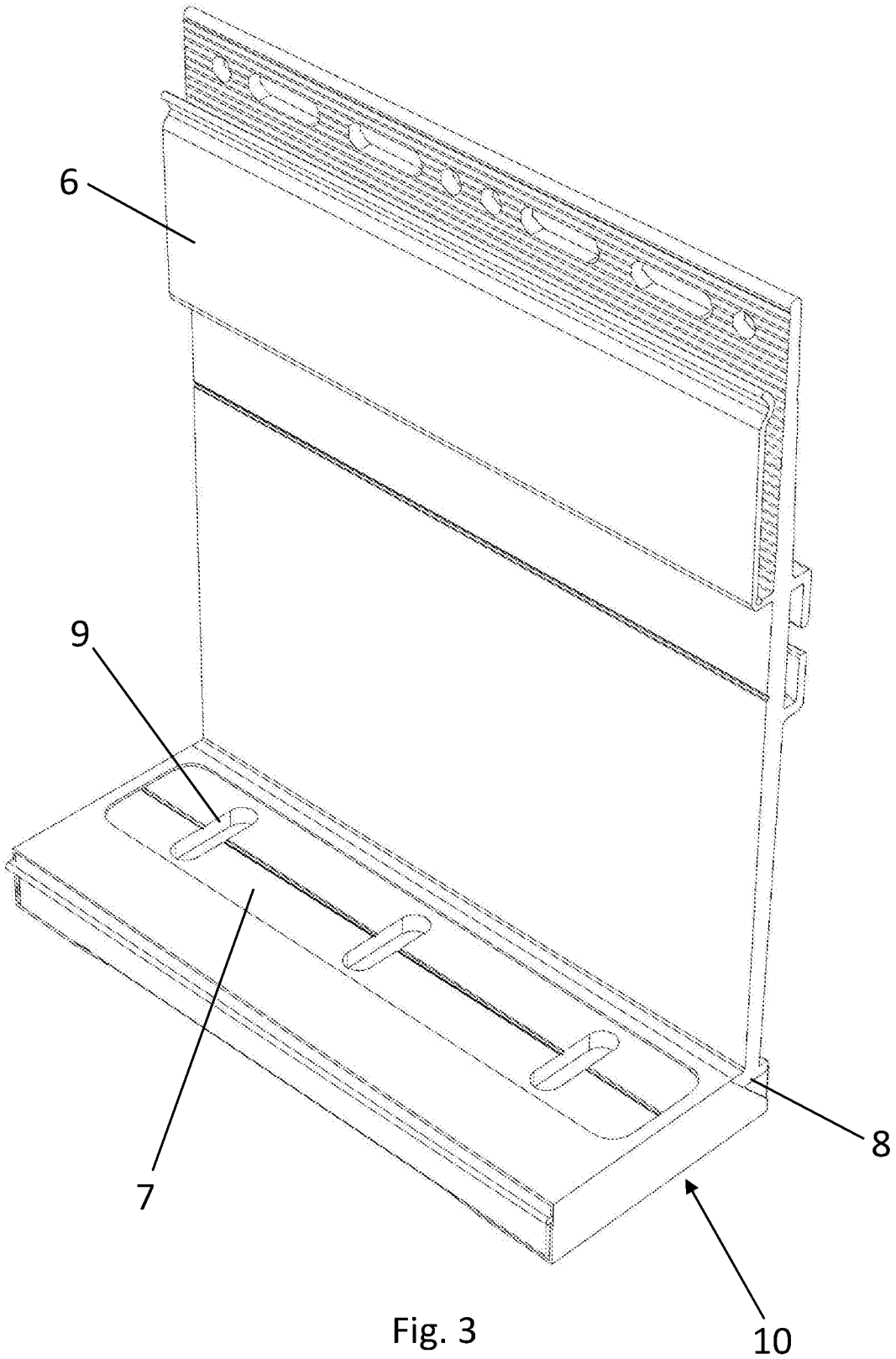
FIG. 3 shows a perspective view of a bracket for attachment to a substructure in a building cladding assembly, which comprises the thermal insulation pad assembly of FIG. 2 attached to a foot thereof.
Figure 4:
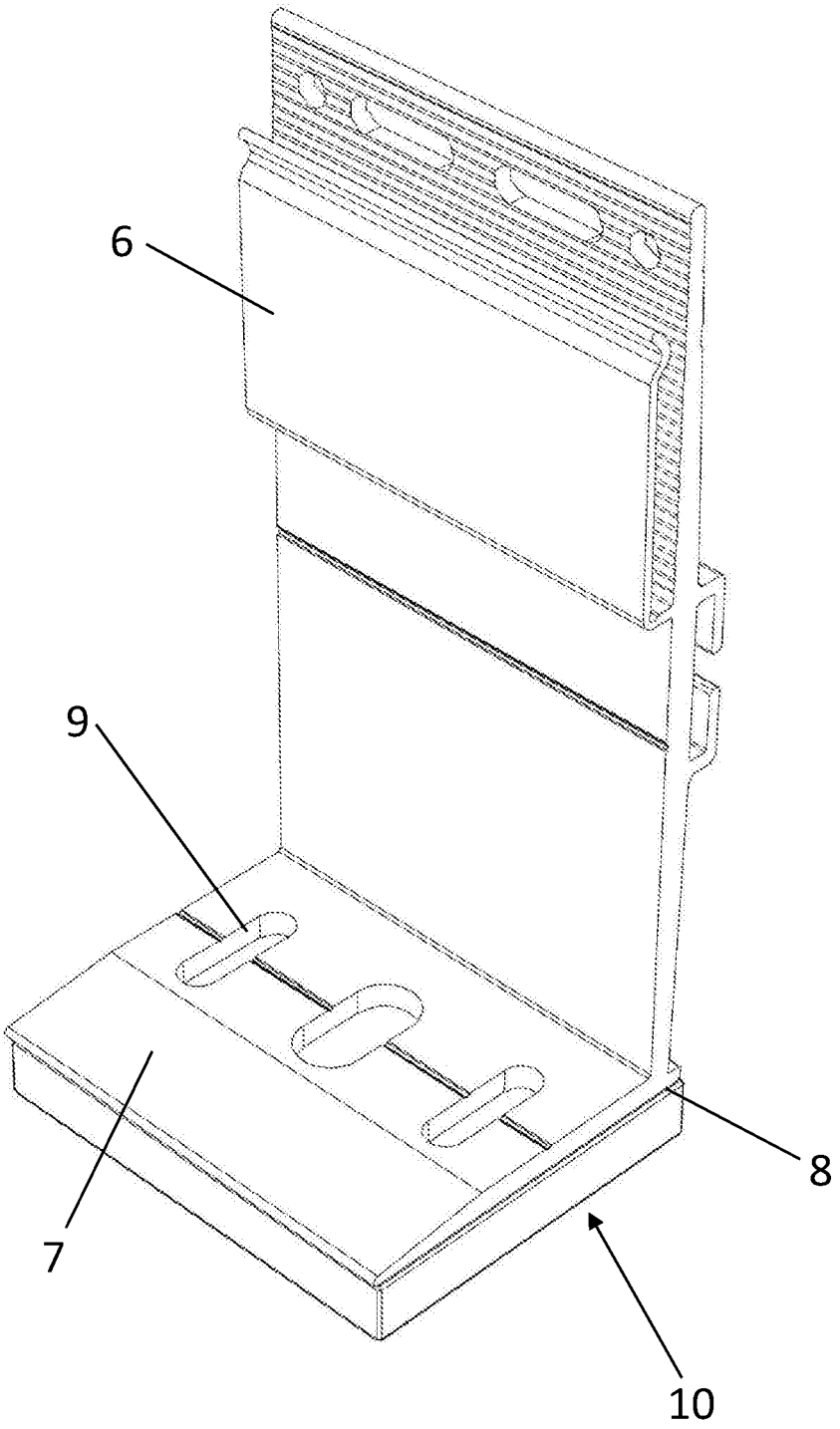
FIG. 4 shows a perspective view of an alternative bracket for attachment to a substructure in a building cladding assembly, which comprises an alternative thermal insulation pad assembly in which the attachment element comprises adhesive.

With reference to FIG. 2, there is shown a thermal insulation pad assembly 10 comprising a thermal insulation pad 1 and an attachment element 5 for attaching the thermal insulation pad 1 (comprising the thermal insulation material 2 and the spacing members 3). With reference to FIGS. 3 and 4, the thermal insulation pad assembly 10 is shown attached to a bracket 6 for use in a building cladding assembly, wherein a first form of attachment element 5 is shown in FIGS. 2 and 3 and a second form of attachment element is discussed with reference to FIG. 4.

The first form of attachment element 5 comprises a cardboard sleeve. The thermal insulation pad 1 is received by the sleeve as shown in FIG. 2. The sleeve preferably comprises an opening 11 to allow (obstruction free) access to openings 9 in the foot 7 of the bracket 6, as seen in FIG. 3. The sleeve has a greater depth than the thickness of the pad 1, such that there is a space 12 provided between the pad 1 and a face of the sleeve. In use, as seen in FIG. 3, the sleeve is slid onto the foot 7 of the bracket 6, wherein the thermal insulation pad 1 contacts a contact face 8 of the foot 7 and the foot 7 is sandwiched between the pad 1 and the face of the sleeve (the upper face of the sleeve with the bracket 6 oriented as in FIG. 3). The compressibility of the thermal insulation material 6 results in an interference fit. Whilst the sleeve is cardboard, which is preferred due to its low cost, thermal and fire properties, it may be plastic or otherwise. Moreover, it need not be limited to the form of the present arrangement for performing the function of attaching the thermal insulation pad 1 to the bracket 6 for installation of the bracket 6, as will be appreciated by those skilled in the art.

The second form of attachment element is an adhesive, wherein the thermal insulation pad 1 is adhered to the contact face 8 of the foot 7. The adhesive may be applied directly to the thermal insulation material 2 of the pad 1 or the pad 1 may be covered, for example by shrink wrapping in plastic, with the adhesive applied to the covering layer. An alternative form of cover may comprise a cardboard box that is suitably sized to receive the thermal insulation pad 1 with a snug fit.

Regardless of the form of attachment, it is preferable that the thermal insulation pad 1 has a footprint substantially equal to the footprint of the foot 7 of the bracket 6.

It should be noted that the form of the bracket 6 for forming part of a building cladding assembly is not limited to the arrangement shown. In the exemplary arrangement shown, the bracket 6 comprises the foot 7 and a neck that extends to a head that is provided at an opposite end of the neck to the foot, the head comprises a pair of opposed plates that are substantially parallel to one another and spaced from one another to provide a mouth for engaging a flange or tail part of a rail system that may in turn support external cladding panels.

Figure 5A:
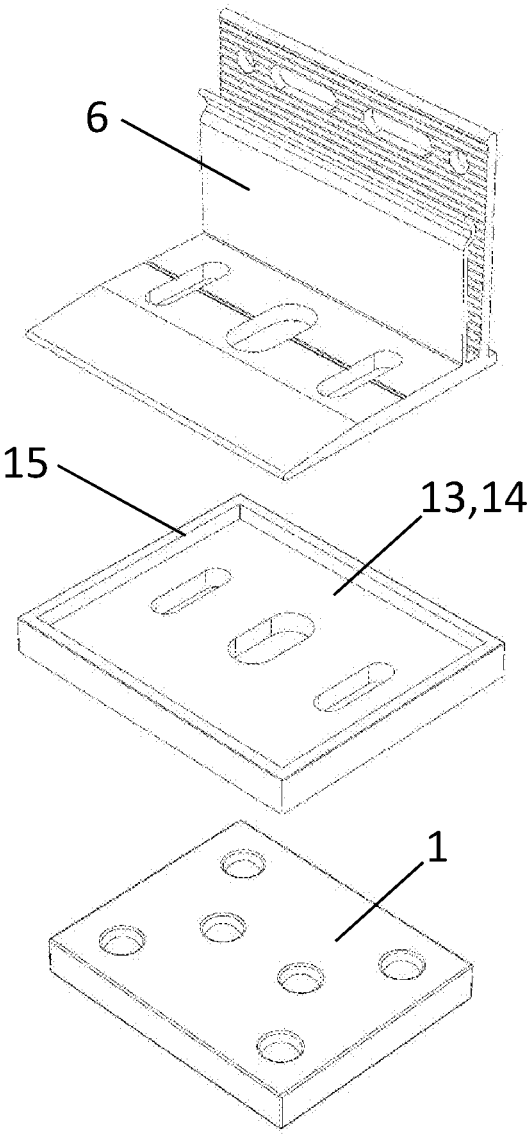
Figure 5B:
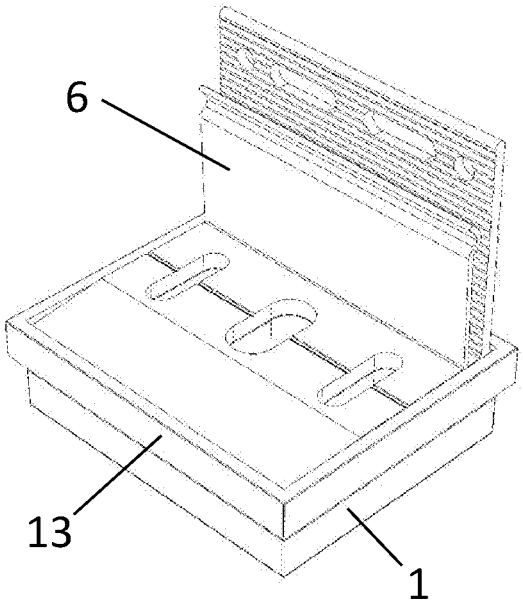

With reference to FIGS. 5*a* and 5*b*, a further bracket is shown, which comprises the bracket 6, the thermal insulation pad 1 and an adaptor 13. The adaptor 13 comprises a plate formed of plastic, which comprises a support surface 14 for positioning in contact against the contact face of the foot 7 and an opposed surface for positioning against the thermal insulation pad 1, as seen in FIG. 5*b*. A raised lip 15 extends around a perimeter of the plate to define a space for at least partially housing the foot 7, as again best seen in FIG. 5*b*. The adaptor 13 may be arranged to snap fit to the foot 7. The thermal insulation pad 1 may be attached to the adaptor using adhesive or otherwise. Any of the above described arrangements that omit the adaptor may be modified by the inclusion of an adaptor.

Whilst a number of exemplary embodiments have been detailed above, those skilled in the art will appreciate that numerous modifications may be made to those embodiments, without departing from the scope of the claims that follow.

We claim:

1. A thermal insulation pad for attachment between a bracket and substructure in a building cladding assembly, the thermal insulation pad being planar in shape and oriented along a plane, the thermal insulation pad comprising:

a thermal insulation material part; and a plurality of spacing members arranged in a two-dimensional array within said thermal insulation material part and in the plane of the thermal insulation pad, such that the plurality of spacing members are distributed in the plane of the thermal insulation pad in both a first direction and a second direction perpendicular to the first direction, so as to limit compression of said thermal insulation material part during attachment between the bracket and the substructure in the building cladding assembly and to define a predetermined uniformed spacing between the bracket and the substructure.

2. The thermal insulation pad of claim 1, wherein said thermal insulation material part comprises a fibrous material.

3. The thermal insulation pad of claim 1, wherein said thermal insulation material part comprises a silica aerogel.

4. The thermal insulation pad of claim 1, wherein each spacing member of said plurality of spacing members is less compressible than said thermal insulation material part.

5. The thermal insulation pad of claim 1, wherein each spacing member of said plurality of spacing members is embedded in said thermal insulation material part.

6. The thermal insulation pad of claim 1, wherein said thermal insulation material part has a thickness in an uncompressed state, and wherein each spacing member of said plurality of spacing members has a dimension equal to said thickness of said thermal insulation material part in said uncompressed state.

7. The thermal insulation pad of claim 1, wherein each spacing member of said plurality of spacing members comprises a ceramic material.

8. The thermal insulation pad of claim 1, wherein each spacing member of said plurality of spacing members comprises a ceramic bead.

9. The thermal insulation pad of claim 1, wherein said thermal insulation material part comprises a plurality of openings, each opening of said plurality of openings receiving at least one spacing member of said plurality of spacing members.

10. The thermal insulation pad of claim 9, wherein each opening of said plurality of openings being in interference fit with a respective at least one spacing member of said plurality of spacing members.

11. A thermal insulation pad assembly, comprising:

a thermal insulation pad according to claim 1; and a means for attaching the thermal insulation pad to a bracket in a building cladding assembly.

12. The thermal insulation pad assembly of claim 11, wherein the means for attaching comprises a sleeve.

13. The thermal insulation pad assembly of claim 12, wherein said sleeve comprises cardboard.

14. A bracket configured for attachment to a substructure in a building cladding assembly, the bracket comprising:

a foot having a contact face being configured to face towards the substructure in use; and a thermal insulation pad according to claim 1, the thermal insulation pad being attached to said foot so as to sit between said contact face and the substructure in use.

15. The bracket of claim 14, wherein said foot has a footprint, and wherein said thermal insulation pad has a pad footprint equal to said footprint of said foot.

16. The bracket of claim 14, further comprising:

an adaptor comprising a plate, the adaptor having a support surface positioned in contact against said contact face and having an opposed surface positioned against said thermal insulation pad.

17. The bracket of claim 16, wherein said adaptor comprises plastic.

18. The bracket of claim 14, further comprising:

a means for attaching said thermal insulation pad to said foot.

19. The bracket of claim 14, wherein the means for attaching comprises a sleeve.

20. A bracket configured for attachment to a substructure in a building cladding assembly, the bracket comprising:

a foot having a contact face being configured to face towards the substructure in use; and a thermal insulation pad being attached to said foot so as to sit between said contact face and the substructure in use, the thermal insulation pad being planar in shape and oriented along a plane, wherein said thermal insulation pad comprises:

a thermal insulation material part; and a plurality of spacing members arranged in a two-dimensional array within said thermal insulation material part and in the plane of the thermal insulation pad, such that the plurality of spacing members are spaced apart in the plane of the thermal insulation pad in both a first direction and a second direction perpendicular to the first direction, so as to limit compression of said thermal insulation material part during use and to define a predetermined uniform spacing between the bracket and the substructure, and wherein said foot has a footprint, and wherein said thermal insulation pad has a pad footprint equal to said footprint of said foot.

* * * * *